United States Patent [19]

Maxwell

[11] Patent Number: 4,878,856

[45] Date of Patent: Nov. 7, 1989

[54] BRACKETED STACKING OF MULTI-PIN CONNECTORS

[75] Inventor: Jack A. Maxwell, San Jose, Calif.

[73] Assignee: Maxconn Incorporated, San Jose, Calif.

[21] Appl. No.: 326,029

[22] Filed: Mar. 20, 1989

[51] Int. Cl.[4] ..... H01R 9/09; H01R 13/73

[52] U.S. Cl. ..... 439/540; 439/532; 439/629

[58] Field of Search ..... 439/532, 540, 527, 569, 439/59, 62, 629, 716, 638

[56] References Cited

U.S. PATENT DOCUMENTS

| | | | |
|---|---|---|---|
| 2,740,944 | 4/1956 | Harrison et al. | 439/540 |
| 3,376,543 | 4/1968 | Hammell | 439/540 |
| 3,702,983 | 11/1972 | Chace et al. | 439/540 |
| 3,905,673 | 9/1975 | Evans et al. | 339/192 R |
| 4,612,602 | 9/1986 | Weyer et al. | 361/394 |
| 4,695,116 | 9/1987 | Bailey et al. | 439/188 |
| 4,818,239 | 4/1989 | Erk | 439/55 |

OTHER PUBLICATIONS

R. G. Maples, "Right-angle Electrical Connector", IBM Technical Disclosure Bulletin, vol. 12, No. 6, Nov. 1969.

IBM Technical Disclosure Bulletin, "Circuit Card Connector Mounting Apparatus", vol. 21, No. 10, Mar. 1979.

*Primary Examiner*—Gary F. Paumen

*Attorney, Agent, or Firm*—Thomas Schneck

[57] ABSTRACT

A stacked electrical connector having a plurality of connector members for attachment to cables of an opposite gender and having angulate contacts which are arranged in a plurality of parallel rows that are received by a printed circuit board or the like. Each connector member has a cable-supporting face and mounting holes on opposed sides of the face. Each bracket of a pair of L-shaped brackets includes a horizontal plate and a vertical plate, with the vertical plate having eyelets aligned with the mounting holes of the connector members. An internally threaded post is inserted into each eyelet and the aligned mounting hole, and is fixed in place. Thus, the L-shaped brackets support the connector members in fixed relation. The posts are internally threaded to receive fastening hardware to mechanically attach a cable to the associated connector member. The vertical plate of each L-shaped bracket extends along a plane common to the base side of the lowermost connector member. Eyelets in the vertical plate receive tangs which are used to mechanically attach the stacked electrical connector to a printed circuit board or the like.

14 Claims, 2 Drawing Sheets

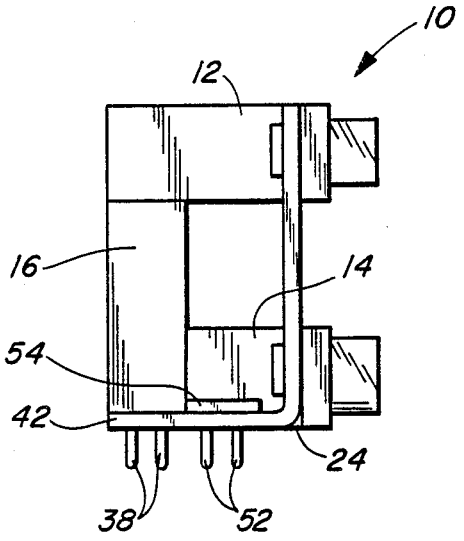
FIG._3.
FIG._4.
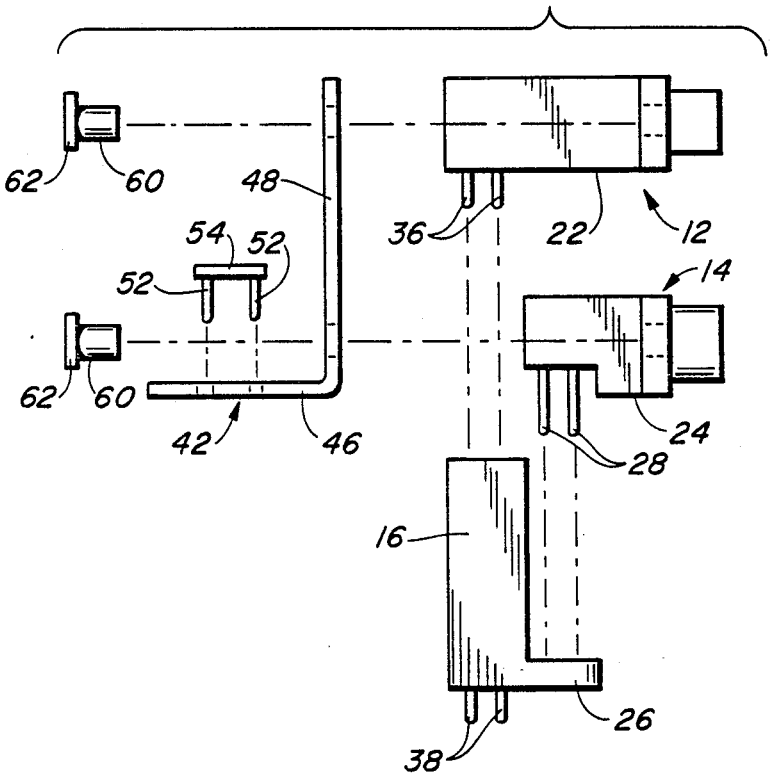

BRACKETED STACKING OF MULTI-PIN CONNECTORS

TECHNICAL FIELD

The present invention relates to electrical connectors and particularly to electrical connectors for insertion into printed circuit boards and the like.

BACKGROUND ART

Multi-pin electrical connectors are often used to provide a large number of reliable connections in the electrical coupling of printed circuit boards within an instrument or in the coupling of various instruments. For example, U.S. Pat. No. 3,905,673 to Evans et al. teaches a connector having right-angle wires which are secured at one end to a printed circuit board and which slidably receive contact elements of an opposite gender at an end opposite the printed circuit board.

In the design of computers and computer peripherals, as well as other types of instruments, the design of smaller components has become important. Consequently, elements such as electrical connectors have undergone dramatic changes in size. An example is the original Type D connector which has largely been replaced by a miniature Type D, with subminiature Type D connectors increasingly replacing the miniature Type D connectors. However, the mounting of even a subminiature connector requires a significant portion of the space of a given-sized printed circuit board, since the contact elements are arranged in staggered rows of standard spacing and since the connector must include ears for receiving mounting screws or other fastening means. Rows of contact elements must be spaced sufficiently apart on a circuit board to insure against shorting among contact elements during soldering.

Commonly, a printed circuit board is required to communicate with more than one outside instrument. Mounting of each succeeding electrical connector to a circuit board further limits the possible size reduction of the circuit board, as well as the design freedom in the mounting of various signals on the circuit board. U.S. Pat. No. 4,695,116 to Bailey et al. teaches a piggyback array of single-orifice phone jack housings, but such an array is much more difficult for receptacles, such as the miniature Type D connectors, which receive a multi-pin element. The multi-pin receptacles typically include mounting holes on opposed sides of a receptacle face configured to slidably receive a plug having staggered rows of contact elements enclosed within the housing. The plug includes ears having bores which are aligned with the mounting holes of the receptacles so that fastening hardware can be used to mechanically lock the plug to the receptacle. Because of the size and the mass of the plugs involved, board space reduction in the mounting of a plurality of multi-pin receptacles, such as Type D connectors includes considerations which are otherwise be relevant in the electrical coupling of devices.

An object of the present invention is to provide a component which minimizes the circuit board space required for mounting of a plurality of multi-contact connectors, with the emphasis on ease of manufacture and use.

DISCLOSURE OF THE INVENTION

The object has been met by a connector having brackets which attach a lower connector member to an upper connector member and which also play a role in attaching the two connector members to multi-pin external articles. In a preferred embodiment the brackets also play a role in attachment of the connector to a printed circuit board. The connector members are stacked bodies for electrically linking printed circuit boards within an instrument or permitting communication among various instruments.

A lower connector member is similar to a conventional right-angle, or orthogonal, connector. The lower connector member has a first cable-support face and has orthogonal contacts arranged in a staggered pattern of at least two rows. An upper connector member is mounted directly atop the lower connector member and includes a second cable-support face and a second set of orthogonal contacts. The orthogonal contacts of the upper connector member have a rearward extension that is greater than that of the lower connector member, permitting the upper contacts unobstructed access to a printed circuit board or the like.

Each of the connector members must be mechanically attached to three elements, i.e. the other connector, a cable and a printed circuit board. In a preferred embodiment mounting brackets have an L-shaped configuration which enters significantly into each of the three mechanical attachments. The brackets have an orientation opposite to the orientation of the orthogonal, or L-shaped, contacts. A horizontal plate of each bracket has a lower surface on a common plane with the base side of the lower connector member. Tangs extend downwardly from the lower surface for insertion into holes in a printed circuit board. Insertion of the tangs maintains the connector in the proper position until the orthogonal contacts can be soldered to the printed circuit board. A vertical plate of each L-shaped bracket includes an upper and a lower eyelet therethrough. The eyelets are aligned with mounting holes on opposed sides of the upper and the lower connector members. Internally threaded posts extend through an eyelet and into the associated mounting hole so as to positionally fix the connector members with respect to each other. Finally, a cable is mechanically locked to a connector member by tightening of fastening screws into the internally threaded posts.

An advantage of the present invention is that two connector members use substantially the same circuit board space as does a single-body mating component. Another advantage is that as a pair the L-shaped brackets enter significantly into providing mechanical attachment of a connector member to a second connector member, to a PC board and to a cable.

BRIEF DESCRIPTION OF THE DRAWINGS

FIG. 3 is a side view of the connector of FIG. 1.

FIG. 4 is an exploded side view of the connector of FIG. 3.

BEST MODE FOR CARRYING OUT THE INVENTION

Figure 2:
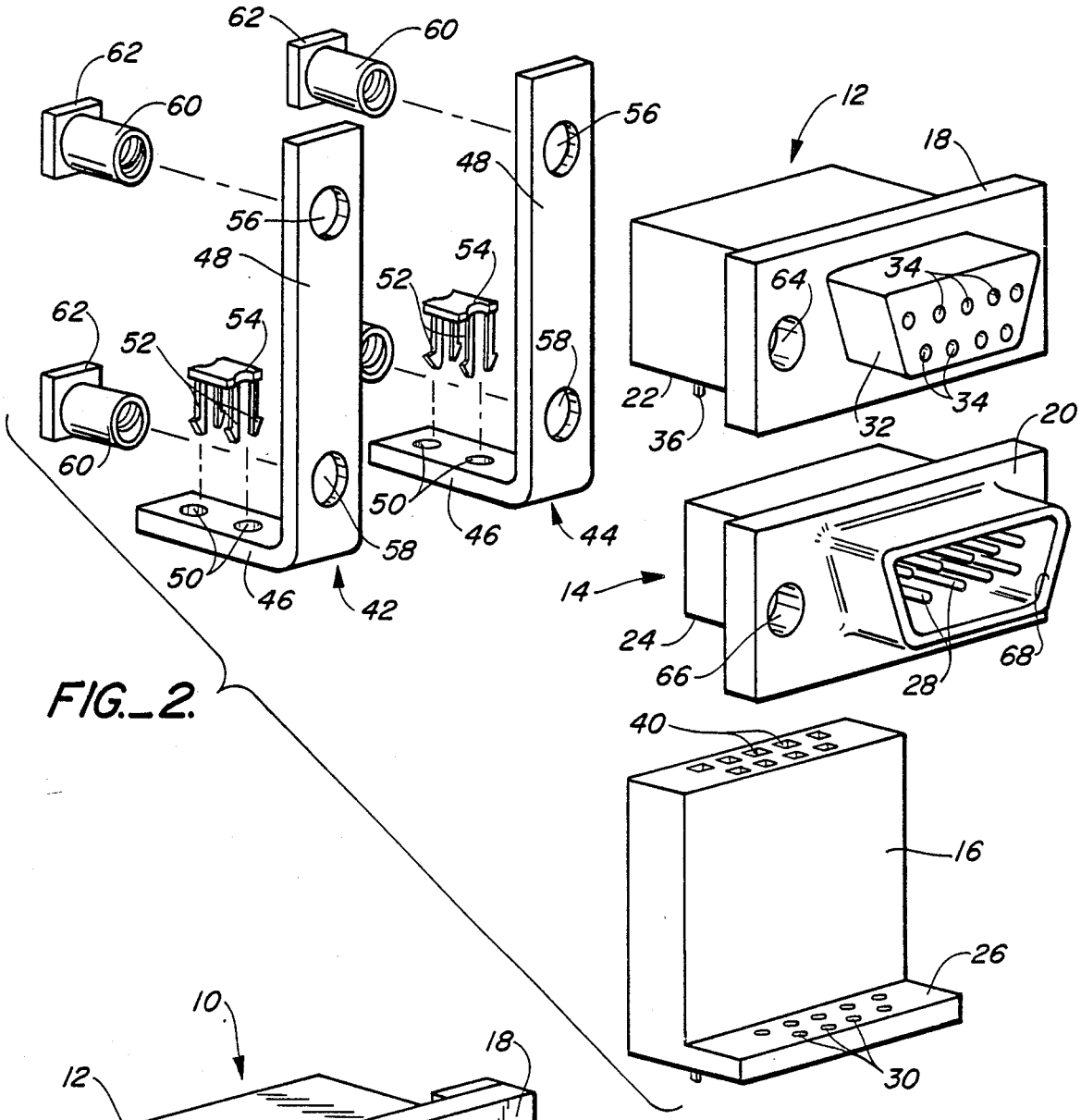
FIG. 2 is an exploded view of the connector of FIG. 1.

With reference to FIGS. 1–4, a stacked electrical connector 10 includes an upper connector member 12, a lower connector member 14, and a pin extension member 16. The illustrated connector members 12 and 14 are sub-miniature connectors and are commonly referred to as Type D. This, however, is not critical.

Each of the connector members 12 and 14 is a multiple-contact member having a front side, or cable-supporting face 18 and 20, and a base side 22 and 24. As best seen in FIGS. 3 and 4, the base side 24 of the lower connector member 14 is stepped to receive a pin-alignment segment 26 of the extension member 16. The lowermost surface of the base side 24 is therefore disposed along a plane common to the lowermost surface of the pin extension member 16. In use, this common plane is further defined as the upper surface of a printed circuit board.

Figure 1:
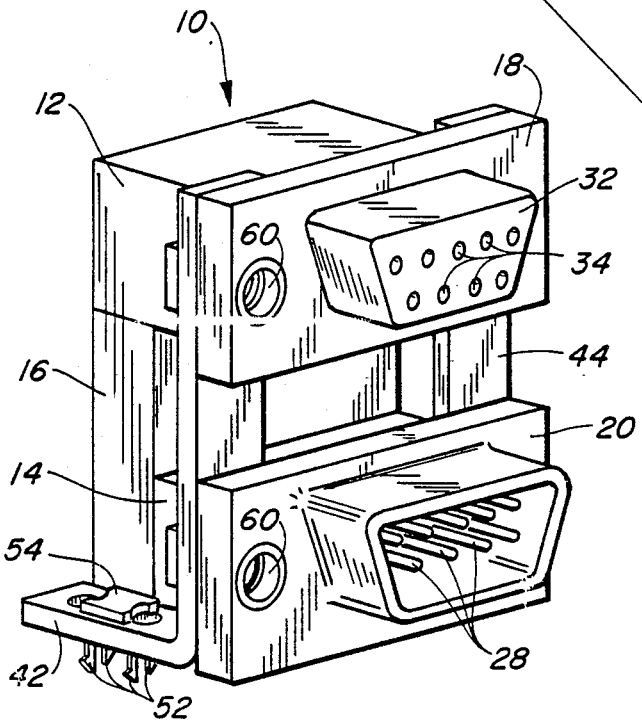
FIG. 1 is a perspective drawing of a stacked electrical connector in accord with the present invention.

The lower connector member 14 has angulate contacts 28 which terminate as pins at the face 20, as shown in FIGS. 1 and 2. The contacts 28 have an inverted L-shaped configuration and depend downwardly from the connector member 14 for insertion into holes 30 in the pin-alignment segment 26 of the extension members 16. The holes 30 act to maintain the angulate contacts 28 in proper position as the stacked electrical connector 10 is mounted onto a printed circuit board.

The angulate contacts 28 of a Type D connector are typically arranged in at least two rows, with the contacts disposed in the rows in an alternating fashion relative to a plane extending parallel to the contacts. This staggered arrangement occurs at both the face 20 and the base side 22.

The upper connector member 12 includes contacts similar to those of the lower connector member 14, but have a receptable end, not shown, at the face 18. A cable-seating portion 32 projects from the face 18 in a manner which resembles the letter "D". It is this similarity to the letter that gives the Type D connector its name. The cable-seating portion 32 is dimensioned to be slightly smaller than a similarly constructed housing of a cable, not shown. Pin-receiving holes 34 in the forward surface permit pins from the cable to be electrically linked to the angulate contacts of the upper connector member 12.

Referring now to FIGS. 3 and 4, the angulate contacts 36 of the upper connector member 12 depend downwardly from the connector member. As in the lower connector member, the contacts 36 are arranged in two rows and are staggered. The present invention is a modular assembly since the stacked electrical connector 10 may be disassembled and the upper and lower connector members may be used independently of each other without modification. This is possible because the removable pin extension member 16 is utilized to electrically extend the angulate contacts 36 of the upper connector member 12 to the same termination plane of the angulate contacts 28 of the lower connector member. The pin extension member 16 includes a number of conductive extension pins 38 matching the number of angulate contacts 36. Each extension pin has a socketed extremity 40, shown in FIG. 2, to slidably receive an angulate contact 36.

The housings of the connector member 12 and 14 are constructed of a dielectric material. The cable-supporting faces 18 and 20 are made of a sturdy material such as steel and are plated with zinc or lead. The angulate contacts 28 and 36 are typically brass with gold flash over an undercoating of nickel. The number of angulate contacts associated with the connector member is not critical, but numbers of 9, 15, 25 and 36 angulate contacts are standard. The pin extension member 16 is made of a dielectric material, with the extension pins 38 constructed in a manner similar to that of the angulate contacts 28 and 36.

In operation a connector member 12 and 14 must be mechanically attached to the other connector member, to a printed circuit board, and to a cable. A pair of L-shaped brackets 42 and 44, best seen in FIGS. 2 and 4, are utilized for such mechanical attachment. The brackets 42 and 44 are unitary members and each comprise a horizontal plate 46 and a vertical plate 48. The brackets are preferably made of a rigid metal.

The horizontal plate 46 of each L-shaped bracket 42 and 44 includes eyelets 50 for tangs 52 of an attachment member 54. The attachment member 54 is adhesively bonded to the horizontal plate 46, but can be fastened by other means known in the art. The tangs 52 are only slightly elastic and are flared at a lower extremity, while the upper longitudinal portion of the tangs has a length corresponding to the standard depth of a printed circuit board. Thus, the tangs 52 can be inserted into holes of a printed circuit board to maintain the stacked electrical connector in a fixed position during soldering of the connector to the circuit board.

The vertical plates 48 of the L-shaped brackets 42 and 44 each have an upper and a lower eyelet 56 and 58. The circumference of the eyelets 56 and 58 is slightly greater than the circumference of a cylindrical post 60 having a rectangular base 62. The rectangular base prevents the cylindrical post 60 from passing completely through an eyelet 56 and 58.

After passage of a cylindrical post 60 through an upper eyelet 56, the cylindrical post enters a mounting hole 64 in the face 18 of the upper connector member 12. A pressure is then placed on the outer ridge of the cylindrical post 60 to flare the outer ridge so that the cylindrical post is locked in position. Stated differently, the outer ridge is treated in a manner identical to a rivet so as to secure the upper connector member 12 to the brackets 42 and 44.

Likewise, a cylindrical post 60 passes through a lower eyelet 58 into a mounting hole 66 of the lower connector member 20. The outer ridge is then flared so that the cylindrical post can no longer be removed. Thus, in addition to playing a role in mechanically attaching the stacked electrical connector 10 to a printed circuit board, the L-shaped brackets 42 and 44 act to secure the upper and lower connector members 12 and 14 in fixed, spaced-apart relation.

The mounting holes 64 and 66 of the connector members 12 and 14 are bores through ear portions of the front sides 18 and 20 of the connector members, as is conventional in the art. Corresponding mounting holes on ear portions of cables which attach to the connector members 12 and 14 are also conventional. A cable slidably fits on the cable-seating portion 32 of the upper connector member 12, but such a fit is not sufficiently secure. However, because the cylindrical posts 60 are internally threaded, the cylindrical posts may receive hex-head screws, not shown, which are likewise internally threaded. Cables typically have cable attachment screws which can be fastened into the internally threaded hex-head screws.

The lower connector member 14 is also slidably fit to a cable at a mouth 68. Again, a slidable fit is not sufficient, so internally threaded hex-head screws are fastened to the cylindrical posts 60 to receive cable-attachment screws. Thus, L-shaped brackets 42 and 44 having eyelets 50, 56 and 58, as shown in FIG. 2, promote ease of manufacture and use since the brackets enter in the triple role of mechanical attachment to a printed circuit board, mechanical attachment of the connector members 12 and 14, and mechanical attachment to external cables.

While the present invention has been explained and claimed by use of relative terms such as "upper", "lower", "vertical" and "horizontal", the present invention is not limited to this orientation. For example, the stacked electrical connector 10 will work equally effectively if turned on a side or if inverted.

I claim:

1. A stacked connector for electrically coupling a printed circuit board to first and second multi-pin external articles comprising, a board-seatable connector member having a first face having means for selectively coupling said board-seatable connector member to a first multi-pin external article, said coupling means including a pair of mounting holes through said first face, said board-seatable connector member having a base wall perpendicular to said first face and further having a first set of angulate contacts originating at said first face and extending through said base wall for attachment to a printed circuit board, spaced apart brackets attached to opposed sides of said board-seatable connector member, each bracket having a planar lower portion parallel to said base wall and an upper portion having an eyelet aligned with a mounting hole through said first face, and a top connector member attached to the upper portion of said bracket and having a second face having means for selectively coupling said top connector member to a second multi-pin external article, said top connector member having a second set of angulate contacts originating at said second face and extending downwardly from said top connector member, and wherein each bracket is an L-shaped bracket, the planar lower portion of each L-shaped bracket being perpendicular to the upper portion.

2. The connector of claim 1 wherein said coupling means of the second face includes a pair of mounting holes through said second face, said upper portion of each L-shaped bracket having an eyelet aligned with a mounting hole in said second face.

3. The connector of claim 1 wherein said angulate contacts of said first and second sets each have an L-shaped configuration having an orientation opposite to said L-shaped brackets.

4. The connector of claim 1 wherein said planar lower portion of each bracket is flush with said base wall of said board-sealable connector.

5. The connector of claim 1 further comprising a pin-extension member made of a dielectric material having a plurality of conductive extension pins, each slidably fit to a portion of an angulate contact of said second set of angulate contacts, said extension pins having ends terminating along a plane common to the extremities of said first set of angulate contacts.

6. A stacked electrical connector, comprising, a lower connector housing having a front side, a plurality of first angularly bent electrically conductive contacts, and having a base side perpendicular to said front side, said front side having a first article supporting face for engaging a first external article and having a pair of mounting holes on opposed sides of said first face, said angularly conductive contacts having first segments originating at said first face and second segments projecting downwardly through said base side, a pair of spaced apart L-shaped brackets mounted to said lower connector housing, each bracket having a horizontal plate parallel to said base side and a vertical plate extending upwardly from said horizontal plate, said vertical plate of each L-shaped bracket having a lower eyelet in alignment with a mounting hole of said lower connector housing and having an upper eyelet, an upper connector housing mounted to said vertical plates of said pair of L-shaped brackets, said upper connector housing having a front side and a plurality of second angularly bent electrically conductive contacts, said front side having a second article-supporting face for engaging a second external article and having mounting holes on opposed sides of said second face in alignment with said upper eyelets of the vertical plates, and means for fastening said upper and lower connector housings to said bracket by mechanically linking each mounting hole to the eyelet in alignment with the respective mounting hole.

7. The stacked electrical connector of claim 6 wherein said first and second conductive contacts have an L-shaped configuration and have an orientation 180° from the orientation of said L-shaped brackets.

8. The stacked electrical connector of claim 6 wherein said front sides of said lower and upper connectors each have flared areas projecting laterally from the respective face, said flared areas having bores therethrough to define said mounting holes.

9. The stacked electrical connector of claim 6 wherein each L-shaped bracket is a unitary member.

10. The stacked electrical connector of claim 6 wherein said fastening means includes a plurality of internally threaded posts, each post being received by one of said eyelets of one bracket and by the mounting hole in alignment with said eyelet.

11. The stacked electrical connector of claim 6 wherein said horizontal plates of said brackets each have a surface along a plane common to a surface of said base side of the lower connector housing.

12. The stacked electrical connector of claim 6 wherein said upper connector housing is spaced apart from said lower connector housing.

13. The stacked electrical connector of claim 6 further comprising a pin-extension member made of a dielectric material having a plurality of conductive extension pins, each pin being slidably fit to a portion of a second conductive contact.

14. The stacked electrical connector of claim 6 wherein said horizontal plates of said brackets include eyelets and wherein said stacked electrical connector further comprises a plurality of tangs projecting through said eyelets for attachment to a printed circuit board.

* * * * *